US005733861A

United States Patent [19]

Gopalkrishnan et al.

[11] Patent Number: 5,733,861

[45] **Date of Patent: *Mar. 31, 1998**

[54] HYDROPHILIC COPOLYMERS FOR REDUCING THE VISCOSITY OF DETERGENT SLURRIES

[75] Inventors: Sridhar Gopalkrishnan, Woodhaven; Kathleen M. Guiney, Wyandotte; John V. Sherman, Allen Park; David T. Durocher, Westland; Michael C. Welch, Woodhaven, all of Mich.

[73] Assignee: BASF Corporation, Mount Olive, N.J.

[ * ] Notice: The term of this patent shall not extend beyond the expiration date of Pat. No. 5,618,782.

[21] Appl. No.: 448,283

[22] Filed: May 23, 1995

[51] Int. Cl.[6] ..... C11D 17/00; C11D 3/37; C11D 11/02

[52] U.S. Cl. ..... 510/418; 510/337; 510/360; 510/361; 510/434; 510/452; 510/476

[58] Field of Search ..... 252/174.23, 174.24, 252/DIG. 2, 174, 173, 89.1; 510/418, 337, 360, 361, 434, 452, 476, 453, 454

[56] References Cited

U.S. PATENT DOCUMENTS

| | | | |
|---|---|---|---|
| 4,215,004 | 7/1980 | Borgerding et al. | 510/325 |
| 4,311,606 | 1/1982 | Kaeser | 510/531 |
| 4,362,640 | 12/1982 | Schreiber | 510/531 |
| 4,368,134 | 1/1983 | Kaeser | 510/532 |
| 4,597,889 | 7/1986 | Jones et al. | 510/337 |
| 5,021,525 | 6/1991 | Montaque et al. | 526/210 |
| 5,147,576 | 9/1992 | Montague et al. | 510/417 |
| 5,534,183 | 7/1996 | Gopalkrishanan et al. | 510/434 |
| 5,536,440 | 7/1996 | Gopalkrishnan et al. | 510/417 |
| 5,595,968 | 1/1997 | Gopalkrishnan et al. | 510/418 |

FOREIGN PATENT DOCUMENTS

| | | |
|---|---|---|
| 58-5398 | 1/1983 | Japan . |
| 2237813 | 5/1991 | United Kingdom . |
| 9106622 | 5/1991 | WIPO . |
| 9106623 | 5/1991 | WIPO . |
| 9109932 | 7/1991 | WIPO . |

OTHER PUBLICATIONS

Derwent Abstract Accession No. 89-372253/51, for EP 346 995, Dec. 20, 1989.

*Primary Examiner*—Ardith Hertzog
*Attorney, Agent, or Firm*—Joanne P. Will

[57] ABSTRACT

An aqueous detergent slurry composition comprising (A) about 5–60% of inorganic builder salts; (B) about 5–70% of detergent active matter selected from the group consisting of anionic, nonionic, cationic, amphoteric and zwitterionic surfactants; and (C) about 0.01–10% of a hydrophilic copolymer comprising a hydrophilic monomer copolymerized with an oxyethylated monomer.

12 Claims, No Drawings

HYDROPHILIC COPOLYMERS FOR REDUCING THE VISCOSITY OF DETERGENT SLURRIES

FIELD OF THE INVENTION

The present invention relates to hydrophilic copolymers, and made particularly, to detergent crutcher slurries that contain the hydrophilic copolymers which permit the reduction of viscosity of such slurries and facilitates their processing during the manufacture of commercial powder detergents.

BACKGROUND OF THE INVENTION

Spray-drying is a typical method of manufacturing powder laundry detergents and involves combining inorganic builder mixtures such as alkali metal bicarbonate, alkali metal carbonate, alkali metal silicate or water-insoluble builders such as zeolite, with water, to form a concentrated slurry. Such slurries typically contain surfactants which are usually anionic in nature, such as linear alkylbenzene sulfonate, alcohol ether sulfates, alcohol sulfates, secondary alkane sulfonates, alphaolefin sulfonates etc. Nonionic surfactants, although not normally included in the crutcher, can be incorporated in the crutcher in small amounts; however, particular attention needs to be devoted to environmental concerns related to "pluming" associated with the spray drying of such slurries. A crutcher composition typically constitutes about 45%–60% solids although it is possible to have a solids content greater than 60% in the crutcher.

Powder detergent compositions typically involve the addition of substantial amounts of alkali metal carbonates, such as sodium carbonate, to the crutcher mix. Alkali metal carbonates, in particular sodium carbonate, can constitute a substantial percentage of the powder detergent formulation, and are added primarily to remove hardness ions such as calcium, via an ion exchange mechanism, and also to provide alkalinity to the wash liquor. In a typical powder detergent manufacturing process, the crutcher mix is processed through a spray tower at very high temperatures to form dry beads. If the detergent formulation contains nonionic surfactants or heat-sensitive ingredients, these additives are sprayed on and absorbed into the dried beads.

A common problem associated with crutcher slurries that contain significant amounts of alkali metal carbonates are their tendency to gel, particularly in the presence of anionic surfactants. This gelling significantly increases the viscosity of the crutcher slurry and makes the crutcher slurry very difficult to process.

In order to reduce the gelation of such slurries for processing, polymeric dispersants have been added to the crutcher mix. Examples of such additives are polycarboxylate polymers such as acrylic polymers and acrylic/maleic copolymers which are added in small amounts, typically about 5% based on the weight of the detergent composition. The addition of polycarboxylates results in the dispersion of solids in the crutcher and thereby reduces the viscosity of the crutcher slurry.

U.S. Pat. No. 4,368,134 teaches the use of water-soluble citric acid salts along with magnesium sulphate to reduce the viscosity of aqueous detergent slurries. U.S. Pat. No. 4,362,640 teaches a method for reducing the viscosity of carbonate based crutcher slurries during the addition of aqueous sodium silicate by adding $CO_2$ with the silicate solution. U.S. Pat. No. 4,311,606 teaches a method of reducing the viscosity of carbonate based crutcher slurries through the addition of sodium sesquicarbonate along with citric acid.

The additives listed in the prior art described above function merely as dispersants and the viscosity reduction achieved via these methods is modest. The inventors have previously found novel hydrophilic polymers useful as stabilizers for the preparation of concentrated built structured liquid detergents. The inventors have now found that these hydrophilic copolymers when incorporated in small amounts in the crutcher slurry composition give a substantial decrease in the viscosity of the slurry. The viscosity decrease with the hydrophilic polymers may be two to three orders of magnitude lower than the viscosity achieved without the polymer in the slurry.

OBJECTS OF THE INVENTION

It is therefore an object of the present invention to incorporate a hydrophilic copolymer into an aqueous detergent slurry composition containing surfactants and inorganic builder salts, which will reduce the viscosity of the crutcher slurry composition.

A further object of the invention is to provide a hydrophilic copolymer useful in reducing the viscosity of concentrated detergent compositions.

Another object is to provide a method of reducing the viscosity of aqueous detergent slurries.

SUMMARY OF THE INVENTION

These and other objects of the invention are achieved by providing an aqueous detergent slurry composition which contains about 5–60% of inorganic builder salts, about 5–70% of detergent active matter selected from the group consisting of anionic, nonionic, cationic, amphoteric and zwitterionic surfactants, and about 0.01–10% of a hydrophilic copolymer comprising an unsaturated hydrophilic monomer copolymerized with an oxyethylated monomer.

The hydrophilic copolymer is preferably of the formula I or II:

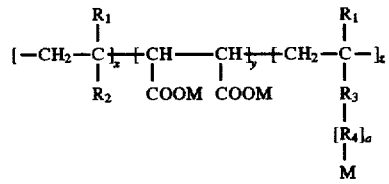

Formula I

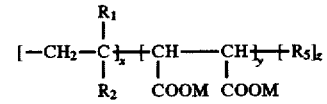

Formula II wherein x, y, and z are integers, (x+y):z is from about 5:1 to 1000:1, and y can be any value ranging from zero up to the value of x; M is an alkali metal or hydrogen; a is an integer from about 3 to about 680; and the hydrophilic and oxyethylated monomers may be in random order;

$R_1$=H or $CH_3$ $R_2$=COOM, $OCH_3$, $SO_3M$, O—CO—$CH_3$, CO—$NH_2$ $R_3$=$CH_2$—O—, $CH_2$—N—, COO—, —O—,

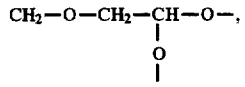

CO—NH—
$R_4$=—$CH_2$—$CH_2$—O
where

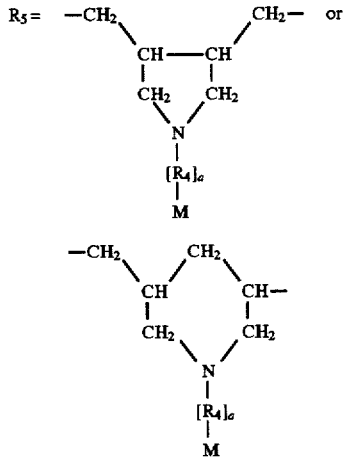

or a mixture of both.

Also provided as part of the invention is a method of reducing the viscosity of aqueous detergent slurries which comprises adding thereto about 0.01–10% of at least one of the above stated hydrophilic copolymer.

DETAILED DESCRIPTION OF THE INVENTION

The aqueous detergent slurry composition comprises about 5–60% of inorganic builder salts; about 5–70% of detergent active matter selected from the group consisting of anionic, nonionic, cationic, amphoteric and zwitterionic surfactants; and about 0.01–10% of a hydrophilic copolymer comprising a hydrophilic monomer copolymerized with an oxyethylated monomer.

The hydrophilic copolymer of the invention preferably has one of the following formulas:

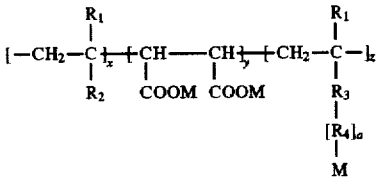

Formula I or

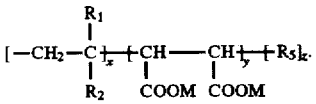

Formula II

Substituents x, y, and z are integers; y can be any value ranging from zero up to the value of x, preferably zero; (x+y):z is from about 5:1 to 1000:1, preferably about 50:1 to 800:1, more preferably about 100:1 to 500:1, and most preferably 125:1.

M is an alkali metal, preferably sodium or potassium, or hydrogen. Substituent a is an integer from about 3 to about 680; preferably from about 8 to about 225, more preferably from about 12 to about 135, most preferably about 15. The hydrophilic and oxyethylated monomers in the hydrophilic copolymer are in random order.

$R_1$=H or $CH_3$, preferably H;

$R_2$=COOM, $OCH_3$, $SO_3M$, O—CO—$CH_3$, CO—$NH_2$, preferably COOM;

$R_3$=$CH_2$—O—, $CH_2$—N—, COO—, —O—,

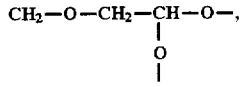

CO—NH—, preferably $CH_2$—O—;
$R_4$=—$CH_2$—$CH_2$—O

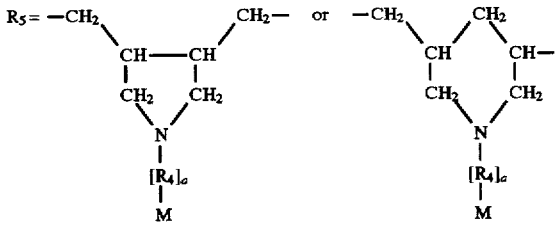

or a mixture of both structures, preferably the first structure.

The total molecular weight of the copolymer is preferably within the range of about 500 to 500,000, as determined by gel permeation chromatography. Preferably, the molecular weight falls within the range of about 1,000 to 100,000; more preferably within the range of about 1,000 to 20,000 (weight average molecular weight—WAMW; unless otherwise specified, molecular weights herein are given in terms of WAMW).

The hydrophilic copolymer of the present invention is prepared by copolymerizing two monomers, an unsaturated hydrophilic monomer copolymerized with an oxyethylated monomer. These monomers may be randomly distributed within the polymer backbone.

The oxyethylated moiety represents a side chain of the oxyethylated monomer. The side chain is hydrophilic in nature, that is, the side chain when isolated from its linkage to the backbone carbon atom has extensive solubility in water.

Examples of unsaturated hydrophilic monomers useful in the present invention include acrylic acid, maleic acid, maleic anhydride, methacrylic acid, methacrylate esters and substituted methacrylate esters, crotonic acid, itaconic acid, vinyl acetic acid, vinyl acetate, vinyl alcohol, methylvinyl ether, and vinylsulphonate. Preferably, the unsaturated hydrophilic monomer component of the hydrophilic copolymer is acrylic acid.

Examples of the oxyethylated monomers useful in the present invention include compounds that have a polymerizable olefinic moiety with at least one acidic hydrogen and are capable of undergoing addition reaction with ethylene oxide. It is also possible to include monomers with at least one acidic hydrogen that are polymerized first, and then subsequently oxyethylated to yield the desired product. Allyl alcohol is preferred since it represents a monofunctional initiator with a polymerizable olefinic moiety having an acidic hydrogen on the oxygen, and is capable of adding to ethylene oxide. Diallylamine represents another monofunctional initiator with polymerizable olefinic moieties, having an acidic hydrogen on the nitrogen, and is capable of adding to ethylene oxide. Other examples of the oxyethylated monomer of the copolymer include reaction products of either acrylic acid, methacrylic acid, maleic acid, or 3-allyloxy-1,2-propanediol with ethylene oxide.

The molecular weight of the oxyethylated monomer according to the various embodiments of the invention will be within the range of about 200 to 30,000, more preferably about 300 to 15,000, and most preferably about 600 to 5000.

Preferred is an oxyethylated monomer which is a ethylene oxide adduct of allyl alcohol. This monomer has a molecular weight of about 700, and $R_4$ is a oxyethylene group represented by the formula —$CH_2$—$CH_2$—O.

A preferred hydrophilic copolymer results from the polymerization of acrylic acid monomer with the ethylene oxide adduct of allyl alcohol, i.e., copolymer of Formula I, where $R_1$=H, $R_2$=COOM where M is sodium, $R_3$=$CH_2$—O, $R_4$ is —$CH_2$—$CH_2$—O, y=0, and a is about 15.

The above-described hydrophilic copolymer is added to detergent slurry compositions, hereinafter described, to reduce viscosity thereto.

The hydrophilic copolymer comprises about 0.01 to 10% by weight of the detergent slurry composition. Preferably, the copolymer of the invention make up about 0.5 to 7% of a typical laundry formulation, even more preferably about 1 to 5%. (Unless otherwise stated, all weight percentages are based upon the weight of the total detergent formulation).

The detergent slurry composition contains about 5 to 60% of inorganic builder salts, preferably about 15 to 50%, and more preferably about 25 to 40%.

The inorganic builder salts may be selected from the group consisting of alkali metal carbonates, alkali metal bicarbonates, alkali metal silicates, alkali metal phosphates, and zeolites. Preferably the detergent slurry composition contains about 25%–45%, preferably about 35%, of alkali metal carbonates such as sodium or potassium carbonate. The builder material sequesters the free calcium or magnesium ions in water and promotes better detergency. Additional benefits provided by the builder are increased alkalinity and soil suspending properties. Water-insoluble builders which remove hardness ions from water by an ion-exchange mechanism are the crystalline or amorphous aluminosilicates referred to as zeolites. Typical zeolites are univalent cation-exchanging compounds and examples of such crystalline types of zeolites are Zeolite A, Zeolite X or Zeolite Y. The above-mentioned zeolites are typically used as builders in detergent compositions. A more detailed description of such types of zeolites can be found in the "Zeolite Molecular Sieves" authored by D. W. Breck. Secondary builders such as the alkali metals of ethylene diamine tetraacetic acid, nitrilotriacetic acid can also be utilized in the detergent compositions of the invention. Other secondary builders known to those skilled in the art may also be utilized.

The detergent slurry composition may also contain about 70% of detergent active matter, preferably about 10–45%, and more preferably about 15%–35%.

The detergent active matter may be selected from the group of anionic, nonionic, cationic, amphoteric and zwitterionic surfactants known to the skilled artisan. Examples of these surfactants may be found in McCutcheon, *Detergents and Emulsifiers* 1993, incorporated herein by reference. Examples of nonionic surfactants will include commonly utilized nonionic surfactants which are either linear or branched and have an HLB of from about 6 to 18, preferably from about 10 to 14. Examples of such nonionic detergents are alkylphenol oxyalkylates (preferably oxyethylates) and alcohol oxyethylates. Examples of the alkylphenol oxyalkylates include $C_6$–$C_{18}$ alkylphenols, preferably $C_7$ TO $C_8$, with about 1–15 moles of ethylene oxide or propylene oxide or mixtures of both. Examples of alcohol oxyalkylates include $C_6$–$C_{18}$ alcohols with about 1–15 moles of ethylene oxide or propylene oxide or mixtures of both. Some of these types of nonionic surfactants are available from BASF Corp. under the trademark PLURAFAC. Other types of nonionic surfactants are available from Shell under the trademark NEODOL. In particular, a $C_{12}$–$C_{15}$ alcohol with an average of 7 moles of ethylene oxide under the trademark NEODOL® 25-7 is especially useful in preparing the laundry detergent compositions useful in the invention. Other examples of nonionic surfactants include products made by condensation of ethylene oxide and propylene oxide with ethylene diamine (BASF, TETRONIC® and TETRONIC® R). Also included are condensation products of ethylene oxide and propylene oxide with ethylene glycol and propylene glycol (BASF, PLURONIC® and PLURONIC® R). Other nonionic surface active agents also include alkylpolyglycosides, long chain aliphatic tertiary amine oxides and phosphine oxides.

Typical anionic surfactants used in the detergency art include the synthetically derived water-soluble alkali metal salts of organic sulphates and sulphonates having about 6 to 22 carbon atoms, preferably 12 to 15 carbon atoms. The commonly used anionic surfactants are sodium alkylbenzene sulphonates, sodium alkylsulphates and sodium alkylether sulphates. Other examples include N-alkylglucosamides, reaction products of fatty acids with isethionic acid neutralized with sodium hydroxide, sulphate esters of higher alcohols derived from tallow or coconut oil, and alphamethylestersulfonates.

Examples of amphoylitic detergents include straight or branched aliphatic derivatives of heterocyclic secondary or tertiary amines. The aliphatic portion of the molecule typically contains about 8 to 20 carbon atoms, preferably 12 to 15 carbon atoms. Zwitterionic detergents include derivatives of straight or branched aliphatic quaternary ammonium, phosphonium or sulfonium compounds.

The detergent slurry compositions heretofore described can be spray dried and additional ingredients such as enzymes, anti-redeposition agents, optical brighteners, as well as dyes and perfumes known to those skilled in the art can be added. Other optional ingredients may include fabric softeners, foam suppressants, and oxygen or chlorine releasing bleaching agents.

The hydrophilic copolymer as part of the invention may be prepared by the skilled artisan according to the process below, in which the ethylene oxide adduct of allyl alcohol is copolymerized with acrylic acid by way of a non-limiting example.

EXAMPLES

The following examples will serve to demonstrate methods of making hydrophilic copolymer, and the efficacy thereof according to various embodiments of the invention. These examples should not be construed as limiting the scope of the invention.

I(A) Preparation of Oxyethylated Monomer (Ethylene Oxide Adduct of Allyl Alcohol)

To a 1 gallon stainless steel autoclave equipped with steam heat, vacuum and nitrogen pressure capability and agitation, a homogenous mixture of 210.5 grams of allyl alcohol and 23.4 grams of potassium t—butoxide were charged. The vessel was sealed, purged with nitrogen and pressurized to 90 psig with nitrogen. The pressure was then readjusted to 34 psig and the temperature of the vessel was adjusted to 80° C. The first 75 grams of ethylene oxide were charged over a 1 hour period at 75°–85° C. and <90 psig pressure. The next 125 grams of ethylene oxide were charged over an hour period at 75°–85° C. and <90 psig. The next 225 grams of ethylene oxide were charged over a 1 hour period at 100°–110° C. and <90 psig. The remaining 2140.9 grams of ethylene oxide were added over an 8 hour period at 145°–155° C. and <90 psig pressure.

After all of the ethylene oxide was added, the mixture was reacted at 150° C. for 2 hours and the vessel was vented to 0 psig. The material was stripped at <10 mm Hg and 125° C. for 1 hour then cooled to 50° C. and discharged into an intermediate holding tank for analysis. The mixture was then considered an allyl alcohol ethylene oxide intermediate.

To a 2 gallon stainless steel autoclave equipped with steam heat, vacuum, nitrogen pressure capability and agitation, 498.8 grams of the allyl alcohol ethylene oxide intermediate were charged. The vessel was sealed and pressurized to 90 psig with nitrogen and vented to 2 psig. This was repeated two more times. The temperature was adjusted to 145° C. and the pressure was readjusted to 34 psig with nitrogen. To the vessel, 2198.3 grams of ethylene oxide were charged at 275 grams per hour. The temperature was maintained at 140°–150° C. and the pressure was maintained at <90 psig. If the pressure rose above 85 psig, the ethylene oxide addition was slowed. If this action failed to lower the pressure, the addition was halted and allowed to react at 145° C. for 30 minutes. The vessel was slowly vented to a 0 psig and repadded to 34 psig with nitrogen. The addition was continued at 140°–150° C. and <90 psig pressure.

After all of the ethylene oxide was added, the material was held at 145° C. for 1 hour. It was then cooled to 90° and 2.9 grams of 85% phosphoric acid were added. The material was mixed for 30 minutes and then vacuum stripped at 100° C. for 1 hour. The batch was cooled to 70° C. and discharged into a holding tank. The ethylene oxide adduct of allyl alcohol product was found to have a number average molecular weight of 4095 g/mol by phthalic anhydride esterification in pyridine.

I(B) Copolymerization of Oxyethylated Monomer with Hydrophilic Monomer (Acrylic Acid)

To a two liter, four-necked flask equipped with a mechanical stirrer, reflux condenser, thermometer, and outlet for feed lines, were added 301 grams of distilled water and 2.6 grams of 70% phosphorous acid. This solution was heated to 95° C. at which time a monomer blend of 555.4 grams of glacial acrylic acid and 62.8 grams of an allyl alcohol initiated ethoxylate (molecular weight @3800) and a redox initiator system consisting of 132 grams of a 38% sodium bisulfite solution and 155.2 grams of a 10.9% sodium persulfate solution, were fed into the flask linearly and separately while maintaining the temperature at 95 (±3)° C. The sodium bisulfite solution and monomer blend feeds were added over 4 hours while the sodium persulfate solution was added over 4.25 hours. The three feeds were added via TEFLON® ⅛ inch tubing lines connected to rotating piston pumps. Appropriately sized glass reservoirs attached to the pumps hold the monomer blend and initiator feeds on balances accurate to 0.1 grams to precisely maintain feed rates.

When the additions are complete, the system was cooled to 80° C. At this temperature, 25.3 grams of a 2.4% 2,2'-Azobis (N,N'-dimethyleneisobutylramidine) dihydrochloride solution were added to the system over 0.5 hours as a postpolymerizer. When addition was complete, the system was reacted for 2 hours at 80° C. After reaction, the system was cooled to 60° C. and the solution pH was adjusted to about 7 with the addition of 658 grams of 50% sodium hydroxide solution. The resultant neutral polymer solution had an approximate solid content of about 40%.

II. Viscosity-Reducing Properties

The following example describes the viscosity reducing properties of the hydrophilic copolymers of the invention when added to aqueous detergent slurry compositions. The numbers in each column in Table-1 refer to the active weight percentage of each component in the detergent formulation. The viscosity values reported in Table-1 are measured with a Brookfield Viscometer (RVT Model) using spindle #4 at 20 rpm. All viscosity measurements were immediately measured after sample preparation at 25° C. The viscosity reducing properties of the hydrophilic copolymers of this invention were evaluated in a concentrated aqueous detergent composition built with different builders such as sodium silicate, sodium carbonate, alkali metal phosphate, and zeolite. The nonionic surfactant used in the formulations shown in the Table-1 is NEODOL® 25-7, a product of Shell. The linear alkylbenzene sulfonic acid, sodium salt (LAS) was obtained from Vista under the name Vista C-560 slurry. The zeolite was "ZEOLITE A", also known as VALFOR® 100, available from the PQ Corp of Valley Forge, Pa. The sodium carbonate was obtained from the FMC corporation under the name "FMC Grade 100". The sodium silicate used was sodium metasilicate pentahydrate obtained from Mayo Products Company. Tetrapotassium pyrophosphate was obtained from the Stauffer Chemical Company.

The performance of Polymer C, a copolymer within the scope of this invention, is compared to conventional polycarboxylates (Polymers A & B) that are widely used in detergent formulations. Polymer A is a sodium salt copolymer of acrylic acid with maleic acid with a weight average molecular weight of 70,000, available from BASF Corporation under the tradename SOKALAN CP5. Polymer B is a sodium salt hompolymer of acrylic acid with a weight average molecular weight of 8000, available from the BASF Corporation under the tradename SOKALAN PA30CL.

TABLE 1

| Ingredient % | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 |
|---|---|---|---|---|---|---|---|---|---|---|---|---|
| LAS | 20 | 20 | 20 | 20 | 20 | 20 | 20 | 20 | 20 | 15 | 15 | 15 |
| Nonionic | | | 7 | 7 | 7 | 7 | 7 | 7 | 7 | 5 | 5 | 5 |
| Sodium Carbonate | 10 | 10 | 29 | 23 | 23 | 23 | 5 | 5 | 5 | | | |
| TKPP | | | | | | | 18 | 18 | 18 | | | |
| Zeolite A | 20 | 20 | | | | | | | | 30 | 30 | 30 |
| Sodium Metasilicate | 10 | 10 | | | | | | | | | | |
| Polymer A | | | | | | 1 | | | | | 1 | |
| Polymer B | | | | | 1 | | | 1 | | | | |
| Polymer C | | 1 | | 1 | | | | | 1 | | | 1 |
| Water | 40 | 39 | 50 | 49 | 49 | 49 | 50 | 49 | 49 | 50 | 49 | 49 |
| Visc. 20 rpm. cps | 5650 | 400 | 4600 | 230 | 4000 | Gel | 1690 | Gel | 80 | 2000 | 2200 | 1570 |

Polymer C shown in Table-1 is a copolymer of acrylic acid with an oxyethylated allyl alcohol, within the scope of the invention. The weight ratio of acrylic acid to the oxylethylated allyl alcohol was 92.3:7.7, while the molar ratio was about 116:1. The oxyethylated monomer component had a molecular weight of about 700, and $R_4$ was $—CH_2—CH_2—O$. In this monomer, $R_1$=H, $R_2$=COONa, $R_3$=$CH_2$—O, and y=0. The weight average molecular weight of Polymer C is about 17,000.

Table-1 illustrates that the copolymers of this invention are able to reduce the viscosity of aqueous detergent slurries containing surfactants and inorganic builders by several orders of magnitude compared to conventional polycarboxylates such as Sokalan CP5 polymer and Sokalan PA30Cl polymer typically used as dispersants for reducing the viscosity of crutcher slurries. The viscosity reducing properties of Polymer C of this invention are also compared to the viscosity of detergent slurries that do not contain a polymer.

While the invention has been described in each of its various embodiments, it is to be expected that certain modifications thereto may occur to those skilled in the art without departing from the true spirit and scope of the invention as set forth in the specification and the accompanying claims.

What is claimed is:

1. An aqueous detergent slurry composition, comprising by weight:

(A) about 5–60% of inorganic builder salts;

(B) about 5–70% of detergent active matter selected from the group consisting of anionic, nonionic, cationic, amphoteric and zwitterionic surfactants; and (C) about 0.01–10% of a hydrophilic copolymer, comprising an unsaturated hydrophilic monomer copolymerized with an oxyethylated monomer.

2. The aqueous detergent slurry composition of claim 1, wherein said hydrophilic copolymer (C) is selected from Formula I, Formula II, or both:

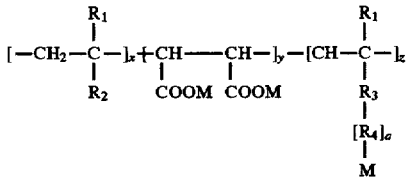

Formula I or

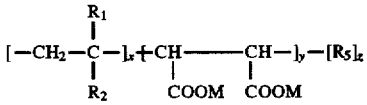

Formula II wherein x, y, and z are integers, (x+y): z is from about 5:1 to 1000:1, and y can be any value ranging from zero up to the value of x; M is an alkali metal or hydrogen; a is an integer from about 3 to about 680; and the hydrophilic and oxyethylated monomers may be in random order;

$R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

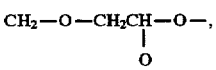

CO—NH—;

$R_4$=—$CH_2$—$CH_2$—O;

Where

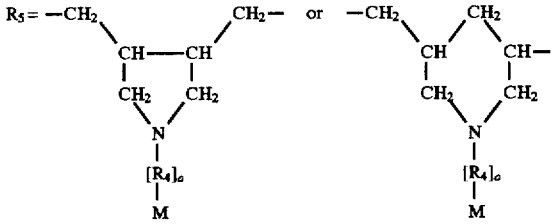

or mixtures of both.

3. The aqueous detergent slurry composition according to claim 2, wherein said hydrophilic copolymer has a molecular weight within the range of about 500 to 500,000.

4. The aqueous detergent slurry composition according to claim 3, wherein said hydrophilic copolymer has a molecular weight within the range of about 1000 to 100,000.

5. The aqueous detergent slurry composition according to claim 4, wherein said hydrophilic copolymer has a molecular weight within the range of about 1000 to 20,000.

6. The aqueous detergent slurry composition according to claim 2, wherein in said hydrophilic copolymer $R_1$=H, $R_2$=COOM where M is sodium, $R_3$=$CH_2$—O, y=0, and a is about 15.

7. A method of reducing the viscosity of aqueous detergent slurries comprising the steps of adding thereto about 0.01–10% by weight of said slurries of a hydrophilic copolymer comprising an unsaturated hydrophilic monomer copolymerized with an oxyethylated monomer wherein said slurries comprise about 5–70% by weight of detergent active matter selected from the group consisting of anionic, nonionic, cationic, amphoteric and zwitterionic surfactants.

8. The method of claim 7, wherein said hydrophilic copolymer has at least one of the following formulas:

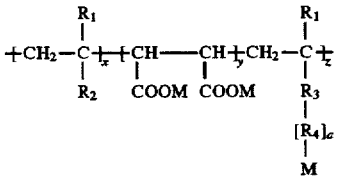

Formula I or

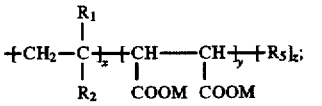

Formula II wherein x, y, and z are integers, (x+y):z is from about 5:1 to 1000:1, and y can be any value ranging from zero up to the value of x; M is an alkali metal or hydrogen; a is an integer from about 3 to about 680; and the hydrophilic and oxyethylated monomers may be in random order;

$R_1$=H or $CH_3$ $R_2$=COOM, $OCH_3$, $SO_3M$, O—CO—$CH_3$, CO—$NH_2$ $R_3$=$CH_2$—O—, $CH_2$—N—, COO—, —O—,

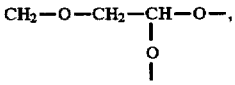

CO—NH—;
$R_4$=—$CH_2$—$CH_2O$;

$R_5$=

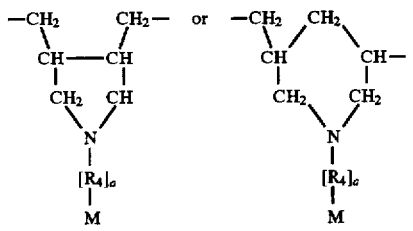

or mixtures of both.

9. The method of claim 8 wherein said hydrophilic copolymer has a molecular weight within the range of about 500 to 500,000.

10. The method of claim 9 wherein said hydrophilic copolymer has a molecular weight within the range of about 1000 to 100,000.

11. The method of claim 9 wherein said hydrophilic copolymer has a molecular weight within the range of about 1000 to 20,000.

12. The method of claim 11 wherein in said hydrophilic copolymer $R_1$=H, $R_2$=COOM where M is sodium, $R_3$=$CH_2$—O, y=0, and a is about 15.

* * * * *